US011516567B2

(12) United States Patent
Chiang

(10) Patent No.: US 11,516,567 B2
(45) Date of Patent: Nov. 29, 2022

(54) MICROPHONE HEAD DEVICE

(71) Applicant: MASCOT ELECTRIC CO., LTD., Tainan (TW)

(72) Inventor: Kun-Tien Chiang, Tainan (TW)

(73) Assignee: MASCOT ELECTRIC CO., LTD., Tainan (TW)

( * ) Notice: Subject to any disclaimer, the term of this patent is extended or adjusted under 35 U.S.C. 154(b) by 0 days.

(21) Appl. No.: 17/387,354

(22) Filed: Jul. 28, 2021

(65) Prior Publication Data

US 2022/0303653 A1 Sep. 22, 2022

(30) Foreign Application Priority Data

Mar. 18, 2021 (TW) ..... 110202895

(51) Int. Cl.
*H04R 1/04* (2006.01)
*H04R 1/08* (2006.01)

(52) U.S. Cl.
CPC ..... *H04R 1/04* (2013.01); *H04R 1/08* (2013.01)

(58) Field of Classification Search
None
See application file for complete search history.

(56) References Cited

U.S. PATENT DOCUMENTS

2016/0112793 A1* 4/2016 Akino ..... H04R 1/2876 381/354
2016/0269830 A1* 9/2016 Chang ..... H04R 9/08

* cited by examiner

*Primary Examiner* — Kenny H Truong
(74) *Attorney, Agent, or Firm* — Muncy, Geissler, Olds & Lowe, P.C.

(57) ABSTRACT

A microphone head device includes a base unit, a microphone head unit and a connecting rod unit. The microphone head unit is disposed on the base unit, and includes a microphone head seat and a dynamic subunit mounted on the microphone head seat. The dynamic subunit includes a mounting seat, a first magnetic member disposed on the mounting seat, a coil surrounding the first magnetic member, and a vibrating plate disposed over the first magnetic member and connected to the coil. The connecting rod unit extends in an up-down direction through the first magnetic member, the mounting seat and the microphone head seat such that the first magnetic member, the mounting seat and the microphone head set are separably secured.

17 Claims, 3 Drawing Sheets

MICROPHONE HEAD DEVICE

CROSS-REFERENCE TO RELATED APPLICATION

This application claims priority to Taiwanese Utility Model Patent Application No. 110202895, filed on Mar. 18, 2021.

FIELD

The disclosure relates to a microphone head device, and more particularly to a microphone head device for a dynamic microphone.

BACKGROUND

The most common types of microphones that are used today are dynamic microphones and condenser microphones. The dynamic microphone converts sound into electrical signals via electromagnetic induction through a microphone head device equipped in the dynamic microphone. A conventional microphone head device includes a base and a microphone head unit disposed on the base. The microphone head unit includes a microphone head seat and a dynamic subunit mounted on the microphone head seat. The dynamic subunit includes a mounting seat, a magnetic member, a coil and a diaphragm. The coil surrounds the magnetic member. The diaphragm is connected to the coil. When sound enters a dynamic microphone, the sound waves cause the diaphragm to vibrate, and the vibrating diaphragm causes the coil to move in the magnetic field generated by the magnetic member. Through electromagnetic induction, the relative motion between the coil and the magnetic member produces a varying current and an electrical signal output.

However, the magnetic member, the mounting seat and the microphone head seat of the conventional microphone head device are adhered together using an adhesive, and the microphone head unit may not be disposed on the base until the adhesive is cured. Thus, it is a time-consuming task to assemble the conventional microphone head device, and maintenance of the conventional microphone head device may be relatively troublesome.

SUMMARY

Therefore, an object of the disclosure is to provide a microphone head device that can alleviate at least one of the drawbacks of the prior art.

According to the disclosure, the microphone head device includes a base unit, a microphone head unit and a connecting rod unit. The microphone head unit is disposed on the base unit and includes a microphone head seat and a dynamic subunit. The dynamic subunit is mounted on the microphone head seat, and includes a mounting seat, a first magnetic member, a coil and a vibrating plate. The first magnetic member is disposed on the mounting seat. The coil surrounds the first magnetic member. The vibrating plate is disposed over the first magnetic member and is connected to the coil. The connecting rod unit extends in an up-down direction through the first magnetic member, the mounting seat and the microphone head seat such that the first magnetic member, the mounting seat and the microphone head set are separably secured.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
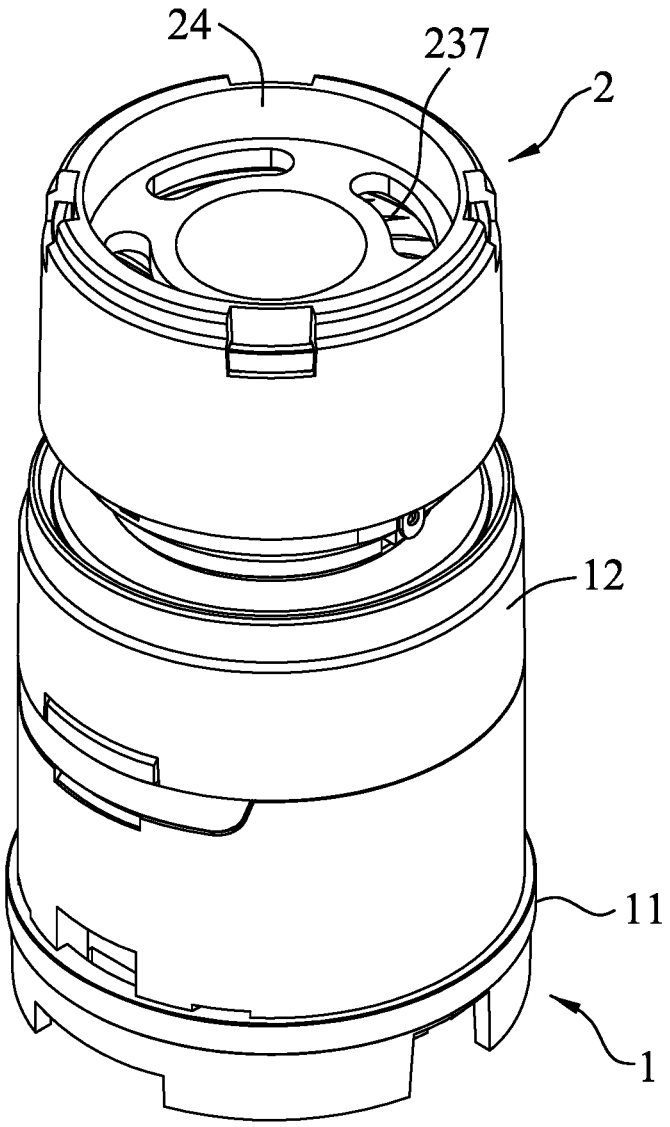
FIG. 1 is a perspective view of an embodiment of a microphone head device according to the disclosure.
Figure 2:
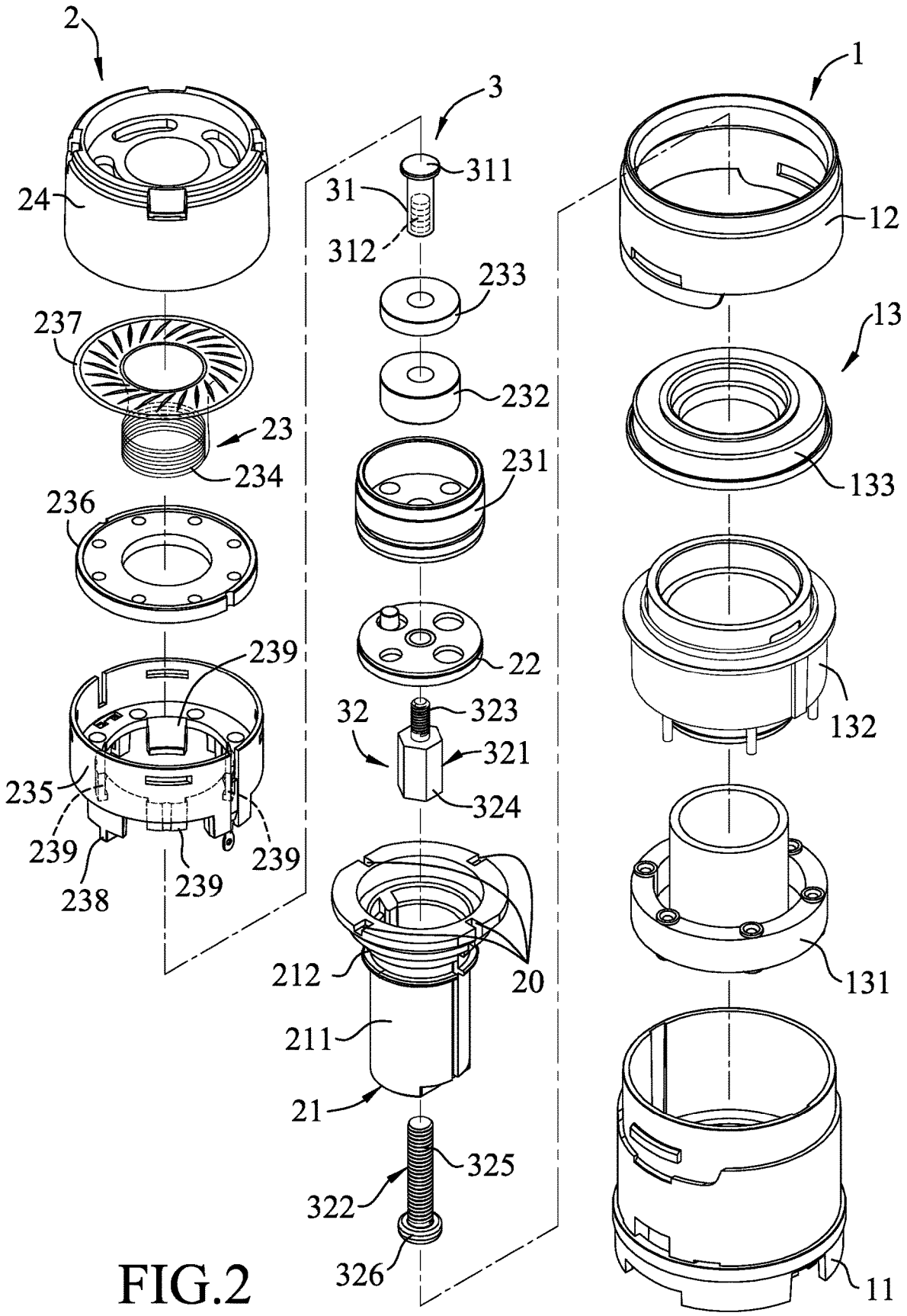
FIG. 2 is an exploded perspective view of the embodiment.
Figure 3:
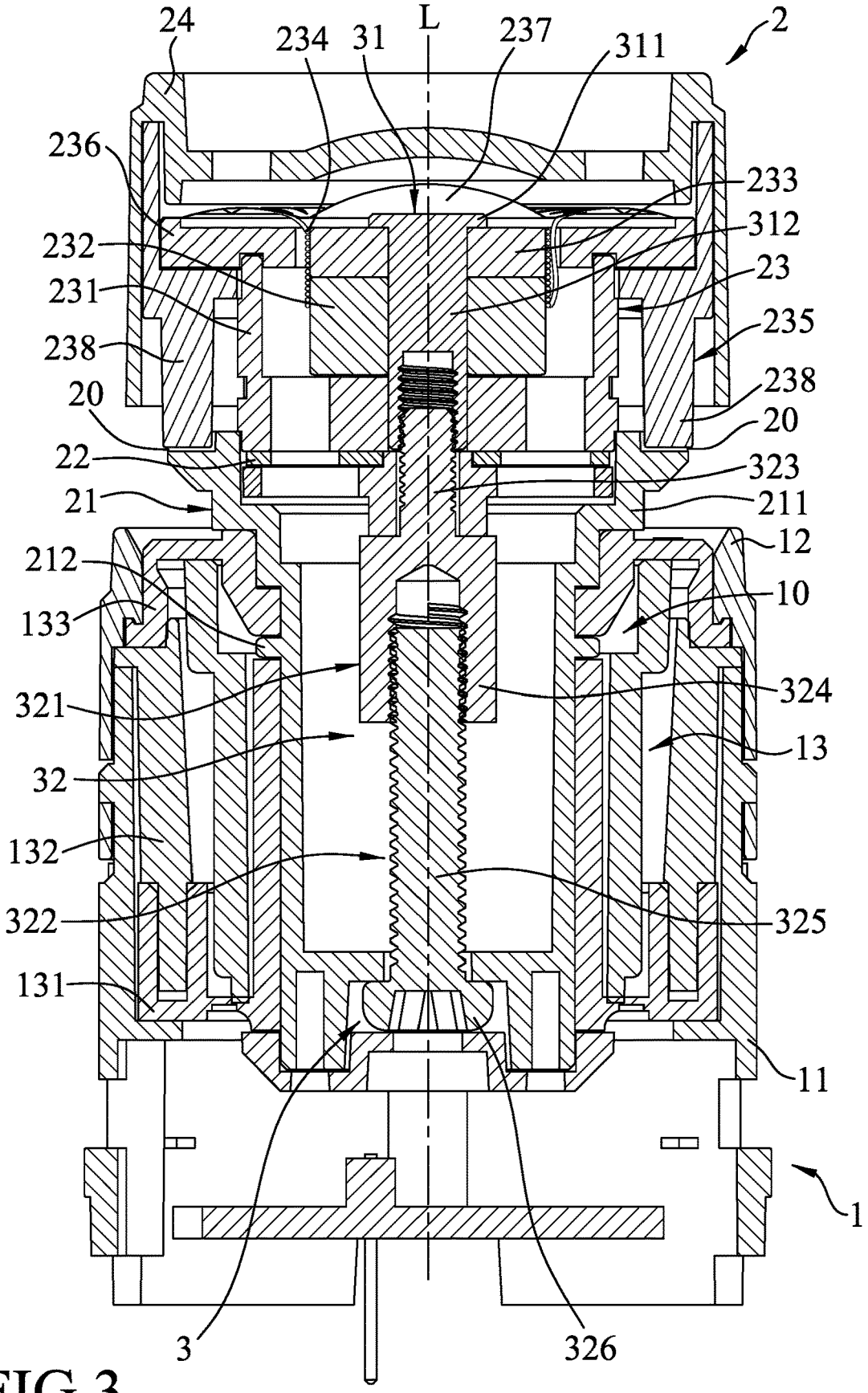
FIG. 3 is a sectional view of the embodiment.

Referring to FIGS. 1 to 3, an embodiment of a microphone head device according to the disclosure includes a base unit 1, a microphone head unit 2 and a connecting rod unit 3. The base unit 1 includes a base body 11, a lower cover 12 and a shockproof subunit 13. The base body 11 is tubular and extends in an up-down direction. The lower cover 12 is sleeved on a top end of the base body 11 and surrounds an axis (L) extending in the up-down direction. The base body 11 and the lower cover 12 cooperatively define a base space in which the shockproof subunit 13 is disposed. The shockproof subunit 13 includes a shockproof rubber 131, a securing seat 132 and a rubber cushion 133. The shockproof rubber 131 is tubular and is disposed in the base body 11. The securing seat 132 is located on and coupled to the shockproof rubber 131. The rubber cushion 133 is ring-shaped and is sleeved on a top end of the securing seat 132. The base body 11, the shockproof subunit 13 and the lower cover 12 cooperatively define a disposing space 10. There will be no further details describing the base unit 1 since the base unit 1 is widely-understood by those skilled in the art and may be designed in many different ways. The configuration of the base unit 1 is not limited to the one disclosed in the FIGS. 1 to 3 mentioned above.

The microphone head unit 2 is disposed on the base unit 1. Specifically, the microphone head unit 2 is inserted into the disposing space 10 of the base unit 1. The microphone head unit 2 includes a microphone head seat 21, a gasket subunit 22, a dynamic subunit 23 mounted on the microphone head seat 21, and an upper cover 24. The microphone head seat 21 has a seat body part 211 and a flange part 212. The seat body part 211 extends in the up-down direction, is tubular, and has a diameter at a top end thereof larger than a diameter at a bottom end thereof. The flange part 212 extends radially and outwardly from an outer surface of the seat body part 211. An outer periphery of the top end of the seat body part 211 is formed with four angularly spaced-apart engaging notches 20. The flange part 212 is clamped between the rubber cushion 133 and the shockproof rubber 131. The gasket subunit 22 is disposed between the microphone head seat 21 and the dynamic subunit 23 to serve as a buffer. In this embodiment, the gasket subunit 22 includes a rubber gasket and a plastic gasket registered with and connected to the rubber gasket in the up-down direction. Since the gasket subunit 22 is a known art and may be designed in many different ways, the configuration of the gasket subunit 22 is not limited to the one disclosed in the FIGS. 1 to 3 mentioned above.

The dynamic subunit 23 includes amounting seat 231, a first magnetic member 232, a washer 233, a coil 234, a shell seat 235, a second magnetic member 236 and a vibrating plate 237. The mounting seat 231 is mounted on a top end of the microphone head seat 21, and is located on and registered with the gasket subunit 22 (i.e., the gasket subunit 22 is disposed between the mounting seat 231 and the microphone head seat 21). Specifically, in this embodiment, the mounting seat 231 is hollow, and has a base wall and a surrounding wall surrounding the base wall. The first magnetic member 232 and the washer 233 are disposed on the base wall of the mounting seat 231. The washer 233 is located over and registered with the first magnetic member 232. The coil 234 surrounds the first magnetic member 232 and the washer 233. The shell seat 235 is sleeved on the mounting seat 231, and surrounds the first magnetic member 232. The second magnetic member 236 is mounted on the mounting seat 231, is flat and ring-shaped, surrounds the coil 234 and the first magnetic member 232, and is located between the mounting seat 231 and the vibrating plate 237. The vibrating plate 237 is disposed over the first magnetic member 232, the coil 234 and the second magnetic member 236, and is connected to the coil 234. Each of the first magnetic member 232, the second magnetic member 236 and the vibrating plate 237 surrounds the axis (L) extending in the up-down direction. The coil 234 is movable relative to the first magnetic member 232 and the second magnetic member 236 in the up-down direction when driven by the vibrating plate 237. The shell seat 235 has a plurality of securing leg parts 238 and a plurality of auxiliary leg parts 239. In this embodiment, the shell seat 235 has two securing leg parts 238 and four auxiliary leg parts 239. The securing leg parts 238 respectively engage two of the engaging notches 20 of the microphone head seat 21. The auxiliary leg parts 239 abut against an outer surface of the mounting seat 231. Specifically, in this embodiment, the outer surface of the mounting seat 231 is formed with an abutting groove that is annular. Each of the auxiliary leg parts 239 has a distal end configured as a hook and engaging the abutting groove of the mounting seat 231 so that the shell seat 235 is clamped around the mounting seat 231.

The connecting rod unit 3 extends in the up-down direction through the washer 233, the first magnetic member 232, the mounting seat 231, the gasket subunit 22 and the microphone head seat 21 such that the washer 233, the first magnetic member 232, the mounting seat 231, the gasket subunit 22 and the microphone head seat 21 are separably secured. The connecting rod unit 3 includes a first connecting rod 31 extending into the dynamic subunit 23, and a second connecting rod subunit 32 extending through the microphone head seat 21 and connected removably to the first connecting rod 31. The first connecting rod 31 has a head portion 311 and a rod body portion 312. The head portion 311 is located over the first magnetic member 232. The rod body portion 312 extends downwardly from the head portion 311 through the first magnetic member 232, is formed with a hole having female threads, and is connected to the second connecting rod subunit 32. Specifically, the washer 233 is disposed between the head portion 311 and the first magnetic member 232. The head portion 311 abuts against a top surface of the washer 233. The rod body portion 312 extends through the washer 233.

The second connecting rod subunit 32 of the connecting rod unit 3 includes an interconnecting rod 321 and a bottom rod 322. The bottom rod 322 extends into the microphone head seat 21 of the microphone head unit 2, and has a bottom section 326 and a body section 325. The bottom section 326 abuts against a bottom surface of the microphone head seat 21. The body section 325 extends upwardly from the bottom section 326 into the microphone head seat 21. The interconnecting rod 321 extends from the microphone head seat 21 into the mounting seat 231, interconnects the first connecting rod 31 and the bottom rod 322, and has an abutting section 324 and an engaging section 323. The abutting section 324 is connected to the bottom rod 322, is disposed under the mounting seat 231 of the dynamic subunit 23, abuts against a bottom surface of the gasket subunit 22 of the microphone head unit 2, and is formed with a hole having female threads. The engaging section 323 extends upwardly from the abutting section 324 through the gasket subunit 22 and into the mounting seat 231, is formed with male threads matching the female threads of the rod body portion 312 of the first connecting rod 31, and is threadedly connected to the rod body portion 312 so that the gasket subunit 22, the mounting seat 231, the first magnetic member 232 and the washer 233 of the dynamic subunit 23 are clamped between the abutting section 324 of the interconnecting rod 321 and the head portion 311 of the first connecting rod 31. The interconnecting rod 321 cooperates with the first connecting rod 31 to secure the washer 233 and the first magnetic member 232 on the mounting seat 231. The body section 325 of the bottom rod 322 is formed with male threads matching the female threads of the abutting section 324 of the interconnecting rod 21, and is threadedly connected to the abutting section 324. The interconnecting rod 321 cooperates with the bottom rod 322 to secure the dynamic subunit 23 and the gasket subunit 22 on the microphone head seat 21.

In this embodiment, the connections between the first connecting rod 31 and the interconnecting rod 321, and between the interconnecting rod 321 and the bottom rod 322 of the connecting rod unit 3 are threaded connections. However, in other embodiments, the type of connection between the first connecting rod 31 and the interconnecting rod 321, or between the interconnecting rod 321 and the bottom rod 322, may not be limited to threaded connections.

In addition, in this embodiment, the washer 233 is disposed between the head portion 311 of the first connecting rod 31 and the first magnetic member 232, so that the first magnetic member 232 can be prevented from abrasion caused by the first connecting rod 31. However, in other embodiments, the washer 233 may be omitted.

In summary, by virtue of the connecting rod unit 3, the first magnetic member 232, the mounting seat 231 and the microphone head seat 21 of the microphone head unit 2 being separably secured, manufacturing process of the microphone head device may be expedited/sped up. Furthermore, by virtue of the second connecting rod subunit 32 including the interconnecting rod 321 and the bottom rod 322, the washer 233 of the dynamic subunit 23, the first magnetic member 232, the mounting seat 231, the gasket subunit 22 of the microphone head unit 2 and the microphone head seat 21 may be assembled in sequence. Therefore, the microphone head device may be easy to assemble and to disassemble, which makes maintenance of the microphone head device relatively easy.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A microphone head device comprising:

a base unit;

a microphone head unit disposed on said base unit and including a microphone head seat, and a dynamic subunit that is mounted on said microphone head seat, and that includes a mounting seat, a first magnetic member disposed on said mounting seat, a coil surrounding said first magnetic member, and a vibrating plate disposed over said first magnetic member and connected to said coil; and a connecting rod unit extending in an up-down direction through said first magnetic member, said mounting seat and said microphone head seat such that said first magnetic member, said mounting seat and said microphone head set are separably secured.

2. The microphone head device as claimed in claim 1, wherein said dynamic subunit further includes a shell seat sleeved on said mounting seat, surrounding said first magnetic member, and having a plurality of securing leg parts that engage said microphone head seat, and a plurality of auxiliary leg parts that abut against an outer surface of said mounting seat.

3. The microphone head device as claimed in claim 2, wherein said connecting rod unit includes a first connecting rod extending into said dynamic subunit, and a second connecting rod subunit extending through said microphone head seat and connected removably to said first connecting rod.

4. The microphone head device as claimed in claim 3, wherein said first connecting rod has a head portion located over said first magnetic member of said dynamic subunit, and a rod body portion extending downwardly from said head portion through said first magnetic member of said dynamic subunit, and connected to said second connecting rod subunit.

5. The microphone head device as claimed in claim 4, wherein said dynamic subunit further includes a washer disposed between said head portion of said first connecting rod and said first magnetic member, said head portion of said first connecting rod abutting against a top surface of said washer, said rod body portion of said first connecting rod extending through said washer.

6. The microphone head device as claimed in claim 5, wherein said second connecting rod subunit includes a bottom rod extending into said microphone head seat, and an interconnecting rod extending from said microphone head seat into said mounting seat of said dynamic subunit and interconnecting said first connecting rod and said bottom rod, said interconnecting rod cooperating with said first connecting rod to secure said washer and said first magnetic member of said dynamic subunit on said mounting seat, said interconnecting rod cooperating with said bottom rod to secure said dynamic subunit on said microphone head seat.

7. The microphone head device as claimed in claim 6, wherein said interconnecting rod has an abutting section connected to said bottom rod and disposed under said mounting seat of said dynamic subunit, and an engaging section extending upwardly from said abutting section into said mounting seat and connected to said rod body portion of said first connecting rod so that said mounting seat, said first magnetic member and said washer are clamped between said abutting section of said interconnecting rod and said head portion of said first connecting rod.

8. The microphone head device as claimed in claim 7, wherein said bottom rod has a bottom section abutting against a bottom surface of said microphone head seat, and a body section extending upwardly from said bottom section into said microphone head seat and connected to said abutting section of said interconnecting rod.

9. The microphone head device as claimed in claim 7, wherein said microphone head unit further includes a gasket subunit disposed between said mounting seat of said dynamic subunit and said microphone head seat, said engaging section of said interconnecting rod extending through said mounting seat and said gasket subunit, said abutting section of said interconnecting rod abutting against a bottom surface of said gasket subunit.

10. The microphone head device as claimed in claim 1, wherein said dynamic subunit further includes a second magnetic member mounted on said mounting seat, surrounding said coil, and located between said mounting seat and said vibrating plate.

11. The microphone head device as claimed in claim 1, wherein said connecting rod unit includes a first connecting rod extending into said dynamic subunit, and a second connecting rod subunit extending through said microphone head seat and connected removably to said first connecting rod.

12. The microphone head device as claimed in claim 11, wherein said first connecting rod has a head portion located over said first magnetic member of said dynamic subunit, and a rod body portion extending downwardly from said head portion through said first magnetic member, and connected to said second connecting rod subunit.

13. The microphone head device as claimed in claim 12, wherein said dynamic subunit further includes a washer disposed between said head portion of said first connecting rod and said first magnetic member, said head portion of said first connecting rod abutting against a top surface of said washer, said rod body portion of said first connecting rod extending through said washer.

14. The microphone head device as claimed in claim 13, wherein said second connecting rod subunit includes a bottom rod extending into said microphone head seat, and an interconnecting rod extending from said microphone head seat into said mounting seat of said dynamic subunit and interconnecting said first connecting rod and said bottom rod, said interconnecting rod cooperating with said first connecting rod to secure said washer and said first magnetic member of said dynamic subunit on said mounting seat, said interconnecting rod cooperating with said bottom rod to secure said dynamic subunit on said microphone head seat.

15. The microphone head device as claimed in claim 14, wherein said interconnecting rod has an abutting section connected to said bottom rod and disposed under said mounting seat of said dynamic subunit, and an engaging section extending upwardly from said abutting section into said mounting seat and connected to said rod body portion of said first connecting rod so that said mounting seat, said first magnetic member and said washer are clamped between said abutting section of said interconnecting rod and said head portion of said first connecting rod.

16. The microphone head device as claimed in claim 15, wherein said bottom rod has a bottom section abutting against a bottom surface of said microphone head seat, and a body section extending upwardly from said bottom section into said microphone head seat and connected to said abutting section of said interconnecting rod.

17. The microphone head device as claimed in claim 15, wherein said microphone head unit further includes a gasket subunit disposed between said mounting seat of said dynamic subunit and said microphone head seat, said engaging section of said interconnecting rod extending through said gasket subunit and into said mounting seat, said abutting section of said interconnecting rod abutting against a bottom surface of said gasket subunit.

* * * * *